166-308 SR

9/7/76 XR 3,978,921

United States Patent [19]

Ross

[11] 3,978,921

[45] Sept. 7, 1976

[54] APPARATUS FOR CRYOTHERMAL FRACTURING OF ROCK FORMATIONS

[75] Inventor: Sigmund L. Ross, Brooklyn, N.Y.

[73] Assignee: Rose Shuffman, Scarsdale, N.Y.

[22] Filed: Nov. 14, 1974

[21] Appl. No.: 523,887

Related U.S. Application Data

[63] Continuation-in-part of Ser. No. 148,048, May 28, 1971, Pat. No. 3,759,329, which is a continuation-in-part of Ser. No. 823,306, May 9, 1969, Pat. No. 3,581,821.

[52] U.S. Cl. ..... 166/57; 166/63; 166/65 R; 166/177; 166/212; 166/187; 166/308

[51] Int. Cl.[2] ..... E21B 23/04; E21B 43/26

[58] Field of Search ..... 166/162, 177, 163, 308, 166/165, 187, 168, 212, 302, 303, 57, 65, 63, 299

[56] References Cited

UNITED STATES PATENTS

| | | | |
|---|---|---|---|
| 1,498,963 | 6/1924 | Haber | 166/58 |
| 1,639,008 | 8/1927 | Shannon et al. | 166/58 X |
| 3,118,503 | 1/1964 | Rike et al. | 166/162 |
| 3,153,449 | 10/1964 | Lebourg | 166/63 X |
| 3,244,232 | 4/1966 | Myers | 166/63 |
| 3,756,317 | 9/1973 | Hall | 166/57 X |

*Primary Examiner*—Stephen J. Novosad
*Attorney, Agent, or Firm*—Richard K. Parsell

[57] ABSTRACT

Apparatus and method for cryogenic flash freezing of confined water in a rock formation with concomitant fracturing of the rock formation utilizes an anchoring device comprising gripping means actuatable responsive to release of pressurized gas effected by opening a valve responsive to the firing of an explosive charge in combination with an elongated container for a cryogenic liquid so that the anchoring device may be positioned with said container depending therefrom in a hole in the rock formation and so that cryogenic liquid so held in position may be forcefully discharged from the container upon opening a valve responsive to the firing of an explosive charge for injection into water confined in the hole or in a cavity or crevice in the surrounding rock formation, the location of water to be flash frozen, if desired, being accomplished by a plug adapted to be fixed in place at different positions and to retain water thereon when fixed in place.

6 Claims, 9 Drawing Figures

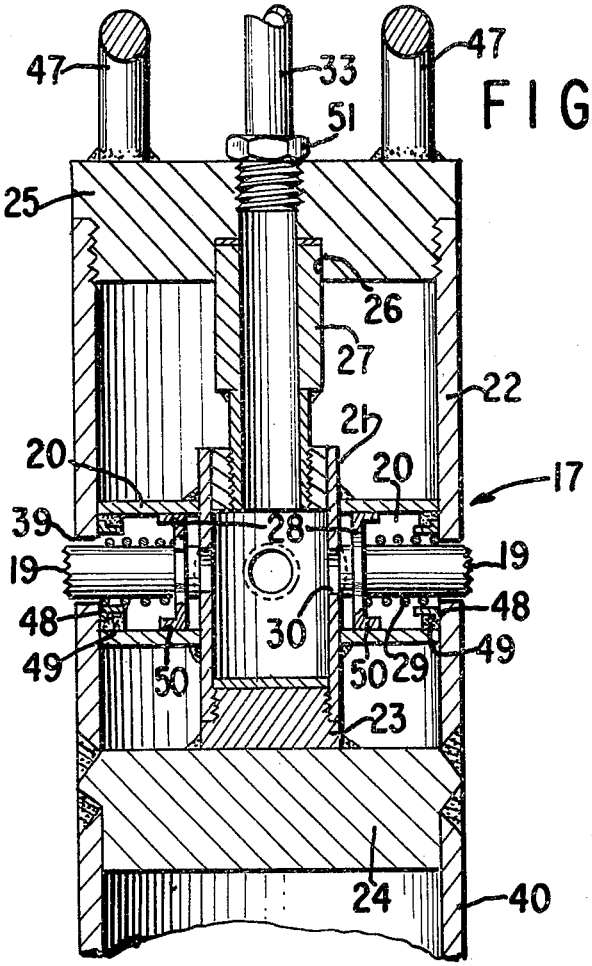
FIG. 3
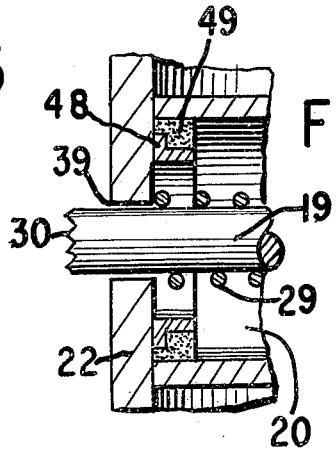
FIG. 4
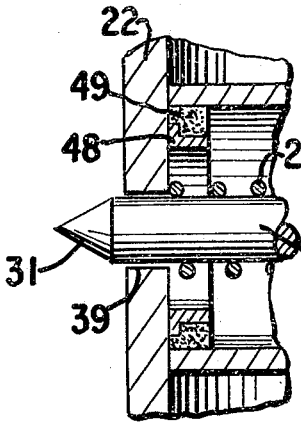
FIG. 5
FIG. 6
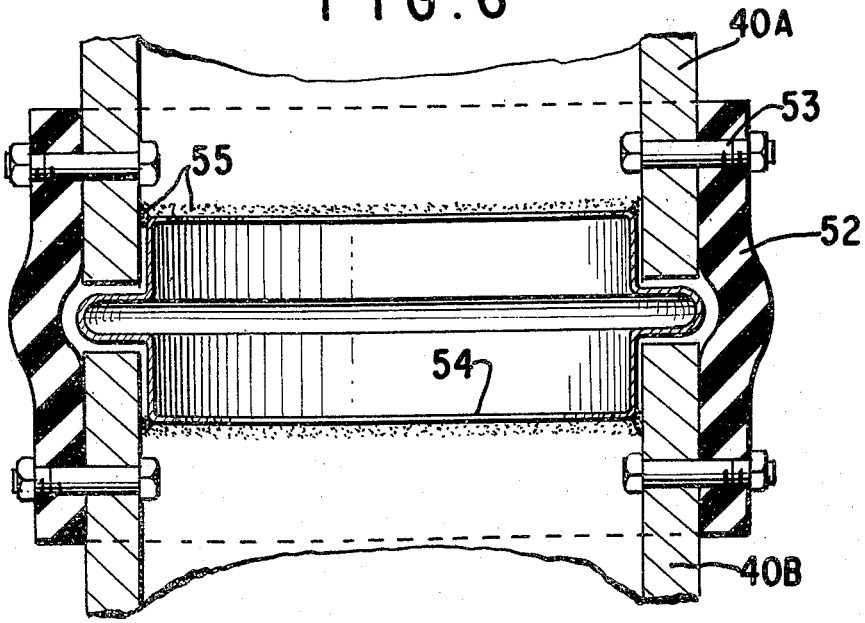

FIG. 7
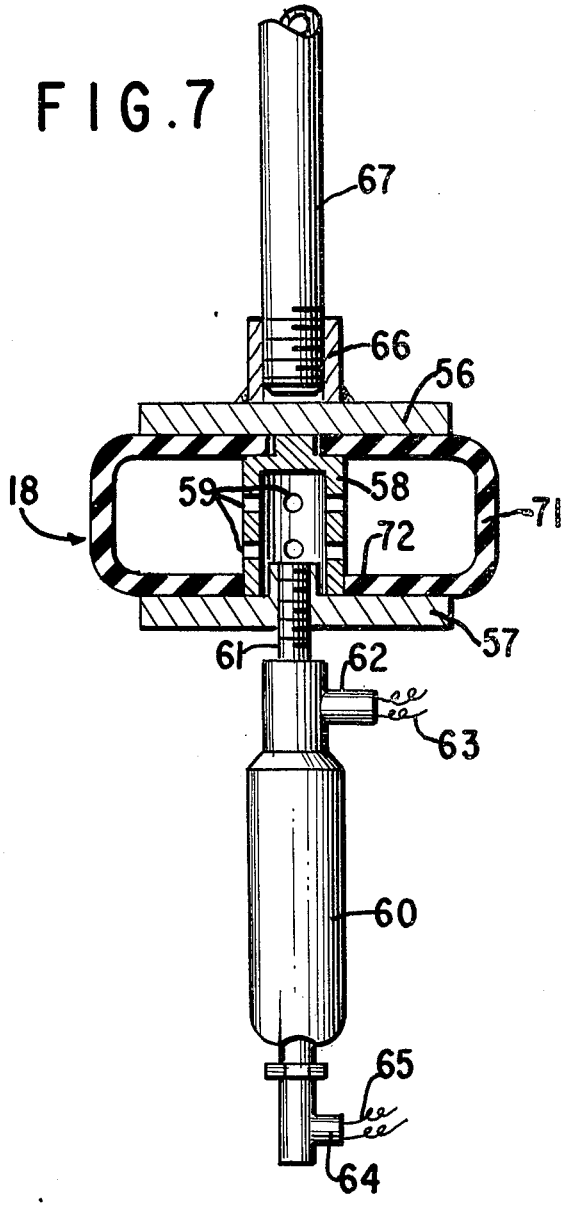
FIG. 8
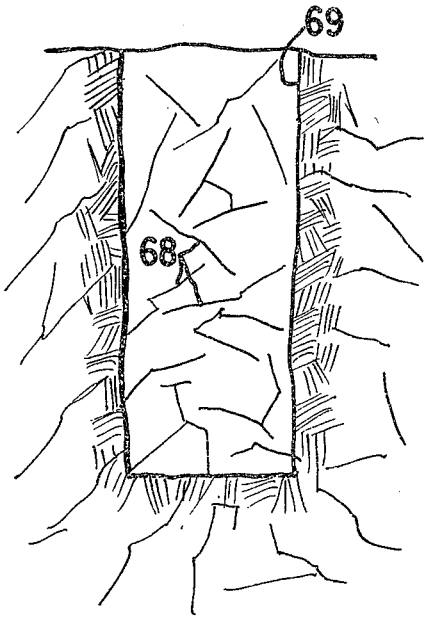
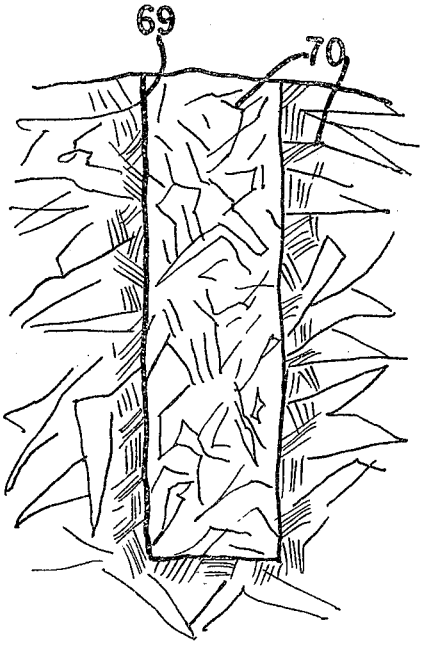
FIG. 9

APPARATUS FOR CRYOTHERMAL FRACTURING OF ROCK FORMATIONS

This is a continuation-in-part of my application Ser. No. 148,048 filed May 28, 1971, and now U.S. Pat. No. 3,759,329, which in turn is a continuation-in-part of my application Ser. No. 823,306 filed May 9, 1969 which resulted in U.S. Pat. No. 3,581,821. The invention relates to the fracturing of rock formations. In my aforesaid applications I have disclosed the cryothermal fracturing of rock formations and likewise have described the use of cryothermal fracturing in conjunction with the use of superheated steam in the recovery of oil from oil-bearing formations. The invention herein disclosed is concerned with apparatus having particular utility in down hole fracturing operations as regards the provision of anchoring and plugging means and the provision of container means for a cryogenic liquid and with means for actuating the components of such apparatus. The invention also is concerned with method and apparatus for accomplishing the forceful projection of a cryogenic liquid into contact with water to be flash frozen and for accomplishing fracing by flash freezing water in a hole at any desired position in the hole. The devices preferably are such that they may be utilized regardless of the direction that the bore of the hole may take, resisting whatever forces that are generated and that act in a line parallel to the longitudinal axis of the bore.

GENERAL DESCRIPTION OF THE INVENTION

In accordance with this invention an elongated container for a cryogenic liquid is provided in combination with means for the support thereof in the form of an anchoring device which is adapted to be lowered to desired position in a hole such as a hole drilled for the purpose of recovering oil from an oil-bearing rock formation and then secured in fixed anchored relation to the side wall of the hole by gripping means which move laterally outwardly relative to the axis of the hole. While the invention pertains to this combination, features of the invention pertain to the anchoring device as such and to the container for the cryogenic liquid as such, including the manner of acutating control valves responsive to the firing of an explosive charge. The container for the cryogenic liquid may be suspended so that the lower end thereof is in close proximity to the surface of free water in the hole and when so suspended it is adapted to block expansion of water in the hole when the water is flash frozen by the release of the cryogenic liquid from the container. While the fracturing force due to the flash freezing of the water is mostly directed laterally, there is some tendency of the ice that is formed to move longitudinally with respect to the axis of the hole and, to the extent that any upward movement of the ice is blocked by the anchored container, the fracturing effect on the rock formation is enhanced.

If the fracturing is to be accomplished at a substantial distance above the bottom of the hole, e.g., at the upper of two oil-bearing strata at different levels, it also is a feature of this invention that an anchoring device is employed that not only securely grips the side wall of the hole but also may be brought into such intimate contact with the side wall of the hole that free water may be retained on the upper surface thereof for a sufficient period of time to permit the lowering of a container of cryogenic liquid into close proximity thereto for release of cryogenic liquid so as to come into contact with the retained water and cause the water to become flash frozen. As aforesaid, the anchored container for the cryogenic liquid serves as a plug to resist upward expansion of ice produced by the release of the cryogenic liquid and when the anchoring plug is used for retaining water, it also serves as a plug which resists any downward expansion of the ice with resulting enhancement of the fracing effect produced by the flash freezing of water confined between the two plugs.

It is one of the features of this invention that cryogenic liquid is caused to come into contact with the water to be flash frozen forcibly so as to penetrate into the water extremely quickly and so that deep penetration of the water is accomplished notwithstanding the virtually immediate flash freezing of the water when the cryogenic liquid comes into contact with it. To accomplish this, the cryogenic liquid is introduced into the container therefor and is held in confinement without release of the gas which is formed because of the absorption of heat by the exterior of the container from the surrounding atmosphere. Ordinarily a receptacle for a cryogenic liquid is provided with vent means which permits escape of gas formed by the evaporation of the cryogenic liquid at a pressure consistent with the strength of the container and thereby prevent explosion. In the practice of this invention the container for the crogenic liquid is made of rugged construction such that if the container is charged with a cryogenic liquid such as liquid nitrogen or liquid carbon dioxide the container will resist pressure build-up over the period of 20 or 30 minutes that is required for lowering the container into an oil well, for example. However, if desired a pressure release valve may be used with the container to permit longer periods of storage prior to release or as a safety precaution. In either case there is pressure build-of of gas formed by evaporation of the cryogenic liquid and this pressure, which becomes very high, is utilized to quickly and forcefully eject the cryogenic liquid through an outlet so as to come into contact with the water to be flash frozen. The quick release of the cryogenic liquid through the outlet is accomplished by the opening of a valve and it is one of the features of this invention that the valve is opened by firing an explosive charge with resulting almost instantaneous release of the cryogenic liquid through the outlet. In this way the cryogenic liquid can be caused to penetrate nearly to the bottom of a column of water about 5 feet in depth in the hole followed by the almost instantaneous flash freezing of the 5-foot body of water accompanied by the fracture of the surrounding rock formation.

In order to suspend the container for the cryogenic liquid in the hole while at the same time enabling it to be used as a plug for resisting upward axial expansion of ice, an anchor is employed which may be lowerd into the hole with the container for the cryogenic liquid suspended therefrom and which can be caused to become anchored in the hole when the container has been positioned at desired location in the hole. To this end the anchor is provided with gripping means that may be moved laterally outwardly relative to the body member of the device and to the longitudinal axis of the hole. The gripping means may assume different forms. Thus the gripping means may be in the form of a plurality of pistons which are adapted to move laterally outwardly with respect to a body member so as to come into secure gripping relation with the side wall of the hole. Preferably the extremities of the pistons are pointed or serrated so as to make the gripping action more effective. The pistons are adapted to be actuated by pressurized gas and it is a feature of this invention that the pressurized gas be provided by a pressurized gas tank wherein the gas pressure is provided by confining a quantity of vaporized cryogenic liquid. The means for directing the pressurized gas into operative relation for actuating the pistons is controlled by a valve which preferably is movable from closed to open position by firing an explosive charge. In this way the valve is opened virtually instantaneously and the confined gas under high pressure is released very suddenly so as to slam into gripping contact with the side wall of the hole and maintain them in gripping relation.

The pistons are in retracted position when the anchoring device is lowered into the hole and preferably are normally held in this position by springs or other resilient means. After the flash freezing of water in the hole has been accomplished by the release of cryogenic liquid from the container therefor that is suspended from the anchoring device it normally is desirable to be able to lift the anchoring device and the suspended container from the hole and it is a further feature of this invention that means is provided for releasing the gripping action of the piston ends on the side wall of the hole. In preferred practice this is accomplished by providing the tank for the pressured gas that actuates the pistons with a second valve-controlled opening through which the pressurized gas may be released into the atmosphere in the hole. Until the valve in this opening is opened, the confined gas remains under high pressure which keeps the pistons forced against the side wall of the hole with great force. However, when the pressure in the tank is reduced by release of the gas confined therein into the surrounding atmosphere, the pistons are free to retract and do so under the influence of the resilient means that normally holds the pistons in retracted position. For convenience as well as effectiveness the valve that is opened to release the pressurized gas from the tank is actuated responsive to the firing of an explosive charge.

According to a further feature of this invention means is provided for accomplishing fracturing at different desired positions in relation to the location of the producing formation or formations as, for example, when there are two such formations at different levels in the invaded rock formation. To this end an anchoring device is provided in the form of a plug that is adapted to be secured at any desired level in the hole and when so positioned is adapted to retain water on the upper surface thereof at a depth suitable for effective flash freezing, e.g., 5 feet of water. The plug not only serves the purpose of making free water available for flash freezing at an intermediate position in the depth of the hole but also provides a plug which resists downward expansion of ice during freezing and thereby augments fracturing effectiveness.

In the water-retaining anchoring plug the means which is moved laterally outwardly with respect to the control body of the plug preferably is in the form of a heavy impervious elastic or resilient annular side wall made of any desired material such as natural or synthetic rubber which may, if desired, be reinforced with embedded fabric or strands. The plug is adapted to confine a pressurized gas admitted into it so as to expand the annular side wall laterally outwardly and cause it to press forcefully against the side wall of the hole and thereby not only hold the plug firmly in place but also retain a desired depth of water in the upper surface of the plug. For supplying pressurized gas to expand the plug when it has been brought to desired position, a container for pressurized gas is connected to the plug and a connecting gas line from the tank to the plug is controlled by a valve which can be opened to admit the pressurized gas into the plug to anchor it in the hole. The opening of the valve is accomplished in response to the firing of an explosive charge under suitable electrical control. The tank for the pressurized gas ordinarily is attached underneath the plug. If it is desired to recover the plug, the tank of pressurized gas may be provided with a valve that may be opened so as to release pressurized gas therefrom with resulting lowering of the pressure of the gas in the plug, thereby permitting the resilient annular side wall of the plug to contract and release the plug. This valve likewise is actuated responsive to the firing of an explosive charge actuatable by electrical control means.

Further purposes, features and advantages of this invention will become apparent from the following as being illustrative of the practice of this invention in connection with certain preferred embodiments of the drawings, wherein;

FIG 1. is a partially sectionalized elevation of a bore hole showing the anchoring and cryogenic devices in place therein;

FIG. 3 is a sectional elevation on a still larger scale of the upper anchoring device that is actuatable responsive to pressurized gas;

FIGS. 4 and 5 are detail sectional elevations showing different configurations for the piston ends whereby firm gripping action may be obtained;

FIG. 6 is a detail sectional elevational of a portion of the tank of cryogenic liquid and is illustrative an optional construction whereby the tank may be articulated for adaptation to a bore hole which may change direction;

FIG. 7 is an elevational partially in section illustrating the construction of the lower anchor which is adapted to serve when anchored in position as a plug for the retention of a body of free water thereon;

FIG. 8 is a diagrammatic representation of fractures in a rock formation after an initial fracturing procedure; and FIG. 9 illustrates the additional fracturing that may be accomplished by subjecting the rock formation to a second fracturing procedure.

Figure 1:
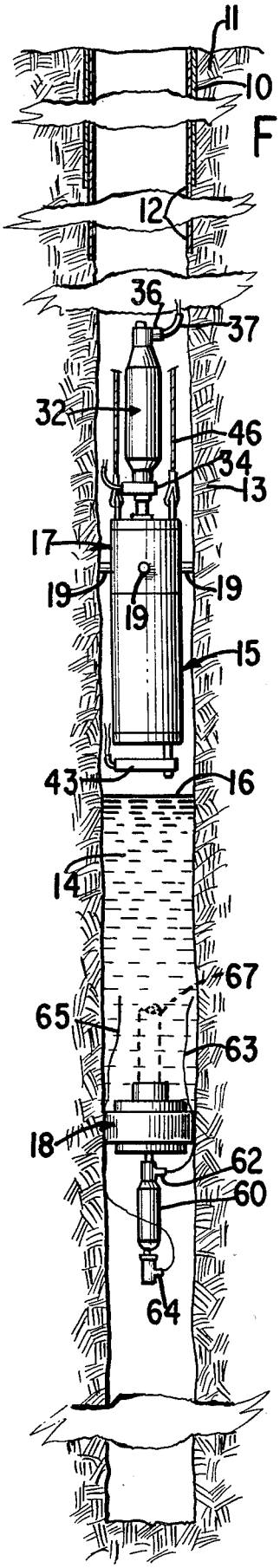

FIG. 1 is illustrative of a typical hole drilled so as to invade an oil-producing formation. The hole is shown with a surface casing 10 adjacent the ground surface 11 and a longer production casing 12 which terminates above the rock formation 13 to be fractured for the purpose of improving flow of oil in the formation into the hole. The fracturing is accomplished by the flash freezing of a body of free water 14 by the injection therein of a cryogenic liquid, preferably liquid nitrogen, that is contained in the fracturing tank 15 which is held in desired position immediately adjacent the surface 16 of the body of free water 14 by the anchor device 17 which is shown anchored to the side wall of the hole.

In FIG. 1 the body of water 14 is shown as being retained in desired position by the anchoring plug 18 which is adapted to retain a body of free water therein long enough to permit the cryogenic liquid to be released into it and convert it into ice. Ordinarily, when drilling into a rock formation, the drilling is discontinued when drilling samples indicate that the bottom of the oil-bearing stratum has been reached. In such case the anchoring plug 18 is not employed and fracturing is accomplished by pouring water into the bottom of the hole, e.g., to a depth of 5 feet, and causing it to be flash frozen using the fracturing tank and anchor combination of this invention. If additional fracturing is desired, the fracturing tank and anchor are pulled up to the surface for recharging and water is poured into the hole to a depth of 5 feet, for example, above the top of the body of ice produced by the initial fracturing procedure. The fracturing tank and anchor combination having again been brought into desired position with the bottom of the tank immediately adjacent the surface of the water, the anchor is locked in place followed by release of the cryogenic liquid to cause flash freezing of the additional 5 feet of water. This process may be repeated as many times as desired.

Under certain circumstances it may be desired to fracture a rock formation at a level in the hole substantially spaced from the bottom of the hole. A situation of this kind is presented, for example, when there are two oil-bearing strata, one of which may be spaced substantially above the other. It is one of the optionally employed features of this invention that fracturing of the upper stratum may be successively accomplished by the use of the anchoring plug 18 as illustrated in FIG. 1. The anchoring plug 18 not only is adapted to be anchored in place at any desired position but also is adapted to retain a body of free water thereon even though the empty hole may extend an indeterminate distance therebelow. In this way the fracturing of the upper stratum may be successively accomplished either before or after the fracturing of the lower stratum regardless of the difference in level between the strata by utilizing the above-described procedure.

The anchoring device indicated generally by the reference character 17 as shown in FIGS. 2 to 5 comprises four pistons 19 mounted for reciprocation in cylinders 20 disposed at 90° to each other radially about the central chamber and secured thereto in gas-tight relation as by welding. A greater or lesser number of pistons may be used as desired for a particular drilling operation. The pistons 19 extend through openings 39 in the cylindrical collar or body member 22, the diameter of which is selected so that the anchor may be freely lowered into the hole while at the same time enabling the pistons 19 when thrust outwardly to grip the side wall of the hole. The chamber 21 may be mounted and held in position in any suitable way as by securing the lower end to the block 23 which is attached as by welding to the disc plate 24 to which the lower end of the collar 22 is secured. The disc plate 25 is removably secured to the upper end of the collar 22 and has a recess 26 therein that is proportioned to receive the upper end of the coupling member 27 the lower end of which is secured to the chamber 21 and is in open communication therewith. Any suitable means may be used to provide a leak-proof connection between the coupling 27 and the disc plate 25 such as a ring gasket or a threaded connection.

Figure 2:
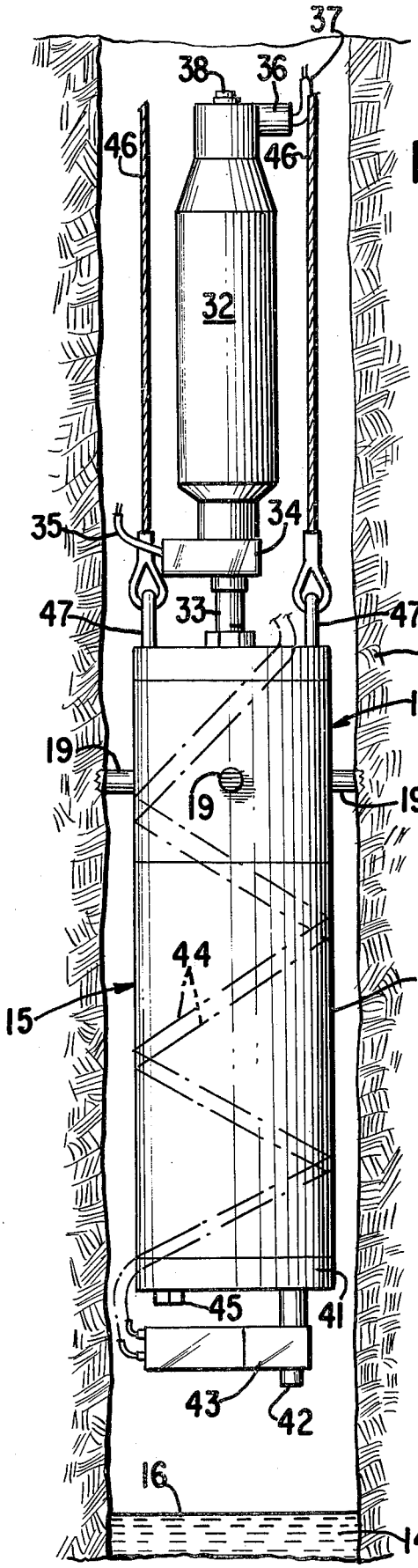
FIG. 2 is a partially sectionalized elevation similar to FIG. 1 but on a larger scale and limited to the combination of the upper anchoring device and a tank of cryogenic liquid depending therefrom.

Each of the pistons 19 has a head 28 that fits slidably within each of the cylinders 20, respectively, and is normally held in retracted position by the spring 29. Each of the cylinders 20 is in open communication with the chamber 21 through openings 30 and when pressurized gas is introduced into the chamber 21 it serves to thrust the pistons laterally outwardly so that the ends firmly grip the side wall of the hole as shown in FIGS. 1 and 2. Preferably the ends of the pistons are shaped at the gripping end to provide maximum gripping contact as by the use of the serrations 30 shown in FIG. 4 or by the use of the pointed shape 31 shown in FIG. 5. Moreover, it is preferable to make the gripping ends of hardened steel. An annular retainer ring 48 is provided adjacent the outer end of each piston 20 which retains an annular ring 49 of lead. The purpose of the lead ring is to seal the piston in place so as to prevent leakage of the gas in the event that the pistons are slammed outwardly with little or no restraint resulting from the ends of the pistons striking the side wall of the hole.

In the practice of this invention the pressurized gas preferably is confined under extremely high pressure and means are provided to release the gas virtually instantaneously so that the pistons may be slammed into the side wall of the hole with great force and thereby become very firmly anchored. To this end a gas tank 32 is employed that is adapted to hold gas under high pressure. Preferably gaseous nitrogen is employed at a pressure of the order of 5,000 p.s.i. The tank 32 is connected by the pipe 33 to the aperture through the plate disc 25 by the bushing 51. Virtually instantaneous release of the pressurized gas at the desired time is accomplished by the valve 34 which is adapted to be opened by the firing of an explosive charge. Any such valve of known type may be used. In such valves the explosive charge is usually provided in the form of a replaceable cartridge which when fired serves to open the valve virtually instantaneously. The firing of the explosive charge is accomplished electrically through wires 35 which are carried to the surface where suitable means (not shown) is provided to complete the circuit for firing the cartridge. When the high pressure gas is released the pistons are first slammed with great force against the side wall and then are held there by the pressure of the gas behind the pistons. When it is desired to remove or change the position of the anchor the gas pressure in the tank 32 is relieved by opening the valve 36 which likewise is of the type that is opened responsive to the firing of an explosive charge by electrical activation through wires 37 that are carried to the surface. As soon as the gas pressure in the tank 32 is released into the atmosphere the pistons 19 become retracted by the action of the springs 29. When it is desired to use the anchor again it is removed from the hole and new firing cartridges and new shearable closures are provided for the valves and the tank 32 is refilled with pressurized gas as by the use of the filling connection 38.

The tank indicated generally by the reference character 15 is referred to herein for brevity as the fracturing tank because it contains the cryogenic liquid used for accomplishing fracture. It comprises the cylinder 40, the upper end of which is closed off by the plate disc 24 which is secured thereto as by welding. The lower end of the cylinder 40 is closed by the end plate 41 which has an outlet 42 extending therethrough that is controlled by the valve 43 which is of the type that is opened responsive to the firing of an explosive charge as hereinabove described. The electrical wires 44 may be coiled about the tank 15 and the anchor 17 for convenience in lowering the tank into the hole and are extended to the surface where suitable control means (not shown) is provided to make the electrical connection for firing the valve 43.

The outlet 42 is designed to project a stream of liquid nitrogen so as to be injected into the body of water 14. The tank 15 is constructed so as to withstand very high pressure and it is one of the features of this invention that the cryogenic liquid, e.g., liquid nitrogen, after having been charged into the tank is held under the pressure created by vaporization of liquid within the container. When filling the tank a space is allowed for building up a body of vapor at very high pressure. If the tank is freshly filled and promptly lowered into the hole the pressure will not exceed the pressure capacity of the tank. However, if desired a high pressure safety valve may be provided. In either case a body of very highly compressed vapor is generated within the tank and by this expedient in combination with instantly actuatably valve 43 a stream of liquid nitrogen or other cryogenic liquid is projected with great force so as to penetrate substantially throughout the depth of the body of water, e.g., 5 feet, notwithstanding the virtually instantaneous freezing of the water. In this way highly effective fracturing by flash freezing is accomplished. By virtue of the rigid construction of the apparatus and the firmness of the anchoring any upward expansion of the ice is effectively resisted thereby augmenting the effectiveness of the fracturing. The tank 15 may be refilled with cryogenic liquid through the filling fitting 45. The size of the fracturing tank 15 will depend on the amount of free water to be frozen as the result of a single injection of liquid nitrogen therein. For example, the hole typically may be 8 inches in diameter and may be filled to provide a depth of 5 feet with water to be frozen, the resulting volume of water being approximately 15 gals. In order to flash freeze this amount of water to produce ice at least −20°F. the required quantity of liquid nitrogen will be about 20 gals.

In a typical procedure, the apparatus which has been charged with liquid nitrogen in tank 15 and with pressurized nitrogen in tank 32 is lowered into the hole by a hoist (not shown) using wire cables 46 which are attached to eyes 47 secured to the disc plate 25 of the anchoring device. The electrical conducting wires for firing the valves trail the apparatus as it descends. When the lower end of the tank 15 becomes positioned above the level of the surface of the water the valve which controls the gas for actuating the anchor pistons is fired, thereby anchoring the apparatus with great firmness. Then the valve which controls the projection of the liquid nitrogen is opened to effect flash freezing of the water and the fracturing of the rock formation that surrounds it. Upon then firing the valve 36 to relieve the pressure in the pressurized gas tank, the anchoring pistons retract to release the anchor and permit the withdrawal of the apparatus from the hole. These operations may be repeated at incremental higher levels until the desired extent of fracturing has been accomplished.

The fracturing tank is of elongated configuration appropriate for containing the desired amount of cryogenic liquid while at the same time permitting it to be freely lowered into a drilled hole of conventional diameter. Sometimes drilling results in a hole that contains one or more curvatures such that the combination of the anchor and fracturing tank may become bound to a greater or lesser extent against the side wall of the hole during lowering. If this is the case greater maneuverability may be had by attaching the fracturing tank to the anchor device by a connection capable of articulation such as a short chain or cable linkage. Greater articulating capability also can be had by the expedient illustrated in FIG. 6 wherein the cylinder 40 is shown in two parts 40A and 40B connected to each other by a flexible connecting band 52 which is made of very strong but flexible material such as fabric-reinforced rubber and which is secured to the cylinders 40A and 40B by the bolts 53. In order to seal in the liquid nitrogen a flexible annulus 54, e.g., of stainless steel, is secured to cylinders 40A and 40B by welding 55.

As mentioned hereinabove, it is one of the optional features of this invention that an anchoring plug, shown generally by the reference character 18 in FIG. 1, may be employed which is capable of maintaining a body of free water to be converted into ice at an intermediate position in the depth of a hole as, for example, when there is a stratum of oil-bearing rock at a level considerably above another such stratum that also is invaded by the same hole but at a considerably lower level. The details of an illustrative embodiment of such an anchoring plug are shown in FIG. 7. The anchoring plug there shown comprises an upper seal plate 56 and a lower seal plate 57 which are secured to each other by the hollow stabilizer member 58 having holes 59 in the side wall thereof. A trough-shaped in-turned annulus 71 is disposed between the two plates with the lower margin 72 secured to the lower plate 57 and with the upper margin in slideable relation to the underside of the upper plate. The annulus 71 is composed of strong but flexible material, e.g., fabric-reinforced rubber, such that when pressurized gas is released into the interior of the annulus the outer wall of the annulus or an annular portion thereof will move laterally outwardly so as to become jammed against the side wall of the hole while at the same time conforming thereto to sufficient extent that a body of water may be retained on the upper surface of the anchoring plug long enough for the fracturing tank to be brought into position for the release of cryogenic liquid which flash freezes the water. At the same time the anchoring plug is anchored so strongly as to contribute to fracturing effectiveness.

The pressurized gas for the anchoring plug 18 is supplied from the tank 60 which is similar in construction and mode of operation to tank 32 and which is connected to the lower plate 57 by the pipe 61. When it is desired to release the pressurized gas to anchor the plug after it has been brought to desired position the valve 62 to which the electrical firing wires 63 are attached is fired. When it is desired to remove the plug the valve 64 is fired by means of firing wires 65, thereby permitting escape of the pressurized gas with accompanying lowering of pressure so as to permit the resilient annular trough to contract to its normal dimensions which are consistent with lowering or raising movements relative to the hole.

In order to better guide the lowering of the anchoring plug into the hole the upper plate 56 is provided with a threaded receptacle 66 to which the pipe 67 may be detachably secured. The plug is lowered into the hole using as many pipe lengths as necessary and serves to maintain the anchor disposed transversely across the hole. When it has been disposed in desired position and after the pressurized gas has been released to anchor it to the side wall of the hole the pipe 67 is removed. When it is desired to recover the anchor after its release, the wires 63 and 64 may be used for the purpose or, alternatively, some other wires (not shown) especially provided for this purpose may be employed.

In the practice of this invention the fracturing effectiveness can be enhanced by permitting the body of ice initially formed by flash freezing a body of free water, e.g., a body of water 5 feet in depth as exemplified hereinabove, to melt with reversion of the ice into water thereby permitting the resulting water to enter into and fill the cracks and recesses produced by the initial fracturing procedure. The melting, if desired, may be accelerated by the release of superheated steam so as to come into contact with the body of ice. Such free water as may remain after the melting of the ice may be removed as by pumping it out while leaving water retained in cracks and recesses produced by the previous fracturing. A cryogenic liquid may thereafter, in accordance with this feature of my invention, be released into the portion of the hole where the initial fracturing occurred, but where a body of free water now no longer exists, until water retained in the cracks and recesses in the formation is frozen into ice with resulting enhancement of the fracturing effect. If desired, superheated steam may be released into the portion of the hole where the ice was melted to heat the surrounding formation. If a significant amount of water thereafter is found to occur in the hole portion in question, but not in the form of a body of free water, the freezing of said water as it occurs in the cracks and recesses in the formation may then be accomplished by the release of cryogenic liquid as above described.

After the fracturing has been affected as described above then flow of oil in the oil-bearing formation may be stimulated by the use of superheated steam as disclosed in my aforesaid application Ser. No. 148,048, now U.S. Pat. No. 3,759,329. While the practice of this invention has been illustrated in connection with a hole in an oil-bearing formation, it is to be understood that it also has application to the fracturing of any lithologic formation in an horizon that surrounds a downwardly extending hole in said formation.

What is claimed is:

1. Apparatus for use in cryogenic fracturing of a rock formation which comprises in combination an anchoring device comprising means actuatably responsive to increase in gas pressure for anchoring said device in anchored relation with respect to the side wall of a hole, a first tank adapted to contain a gas under pressure, a second tank of elongated configuration adapted to hold a cryogenic liquid, said first and second tanks being secured to said anchoring device with said anchoring device therebetween, conduit means connecting said first tank with said anchoring device for directing pressurized gas into said anchoring device to actuate said device, a valve in said conduit means, means responsive to firing an explosive charge for opening said valve to permit flow of pressurized gas through said conduit means into said anchoring device, and outlet at the end of said second tank remote from said anchoring device, a valve in said outlet, and means for opening said valve responsive to firing an explosive charge to release cryogenic liquid through said outlet.

2. Apparatus according to claim 1 wherein said anchoring device comprises means responsive to decrease in gas pressure for releasing said anchoring devices from anchored relation with the side wall of a hole, and means operative to reduce the gas pressure in said anchoring device to release it from said anchored relation responsive to firing an explosive charge.

3. Apparatus for use in cryogenic fracturing of a rock formation which comprises an anchoring device for use in a hole in the rock formation, which anchoring device comprises a body member having peripheral surface dimensioned for disposition when inserted in said hole in proximate spaced relation to the inner side wall of the hole, gripping means for gripping the side wall of said hole, means for mounting said gripping means on said body member for lateral movement relative to the axis of the hole into gripping relation with said side wall, means responsive to pressurized gas to move said gripping means into gripping relation to said side wall, gas supply means connected to said body member for supplying pressurized gas into operative relation for moving said gripping means into gripping relation with said side wall, said gas supply means comprising a valve which controls supply of pressurized gas into said operative relation with said gripping means, and means for moving said valve to open position when said anchoring device has been positioned in said hole to thrust said gripping means responsive to release of pressurized gas into gripping relation to the side wall of the hole by the firing of an explosive charge; said anchoring device being in combination with an elongated container for a cryogenic liquid, that adjacent one end thereof is attached to said anchoring device in position for entering said hole in advance of said anchoring device and that has an outlet adjacent the other end thereof for discharge of cryogenic liquid from said container, a valve in said outlet for controlling flow of cryogenic liquid through said outlet, and means for actuating said valve responsive to firing an explosive charge.

4. Apparatus for use in cryogenic fracturing of a rock formation surrounding a hole which comprises an anchoring device adapted to be lowered to desired position in said hole, said anchoring device comprising gripping means movable laterally relative to the axis of said hole, means actuatable for moving said gripping means into gripping relation with the wall of the hole to anchor said anchoring device in said hole and for return of said gripping means to non-gripping relation to said hole, an elongated tank supported by said anchoring device adapted to be lowered into said hole having an outlet adjacent its lower end in advance of said anchoring device, a valve for controlling discharge of cryogenic liquid through said outlet, and means for opening said valve responsive to firing an explosive charge to release cryogenic liquid from said tank through said outlet underneath said anchoring device when said anchoring device is anchored to the side wall of said hole by said gripping means.

5. Apparatus according to claim 4 which comprises electrical means for firing said explosive charge.

6. Apparatus for use in cryogenic fracturing of a rock formation surrounding a hole which comprises an anchoring device adapted to be lowered to desired position in said hole, said anchoring device comprising gripping means movable laterally relative to the axis of said hole, means actuatable for moving said gripping means into gripping relation with the wall of the hole to anchor said anchoring device in said hole and for return of said gripping means to non-gripping relation to said hole, an elongated tank supported by said anchoring device adapted to be lowered into said hole having an outlet adjacent its lower end in advance of said anchoring device, a valve for controlling discharge of cryogenic liquid through said outlet, and means for opening said valve to release cryogenic liquid from said tank through said outlet underneath said anchoring device when said anchoring device is anchored to the side wall of said hole by said gripping means, said tank comprising articulating means at an intermediate position between the ends thereof.

* * * * *